US011056085B2

(12) United States Patent
Jiménez et al.

(10) Patent No.: US 11,056,085 B2
(45) Date of Patent: Jul. 6, 2021

(54) STRINGED MUSICAL INSTRUMENT WITH FRETS THAT ARE JOINED TOGETHER AND DIVIDE THE FINGERBOARD INTO INDEPENDENT DETACHABLE PIECES

(71) Applicants: Francisco Javier Alonso Jiménez, Madrid (ES); Pablo del Real Fernández, Madrid (ES)

(72) Inventors: Francisco Javier Alonso Jiménez, Madrid (ES); Pablo del Real Fernández, Madrid (ES)

( * ) Notice: Subject to any disclaimer, the term of this patent is extended or adjusted under 35 U.S.C. 154(b) by 0 days.

(21) Appl. No.: 16/755,166

(22) PCT Filed: Sep. 20, 2018

(86) PCT No.: PCT/ES2018/070609
§ 371 (c)(1),
(2) Date: Apr. 10, 2020

(87) PCT Pub. No.: WO2019/073096
PCT Pub. Date: Apr. 18, 2019

(65) Prior Publication Data

US 2020/0251076 A1 Aug. 6, 2020

(30) Foreign Application Priority Data

Oct. 13, 2017 (ES) ..... ES201731208

(51) Int. Cl.
*G10D 3/06* (2020.01)
*G10D 1/05* (2020.01)

(52) U.S. Cl.
CPC ..... *G10D 3/06* (2013.01); *G10D 1/05* (2020.02)

(58) Field of Classification Search
CPC ..... G10D 3/06; G10D 1/05
See application file for complete search history.

(56) References Cited

U.S. PATENT DOCUMENTS 2,492,845 A * 12/1949 Conkling ..... G10D 3/06 84/314 R
3,273,439 A * 9/1966 Keefe ..... G10D 3/06 84/314 R
4,221,151 A * 9/1980 Barth ..... G10D 3/06 84/293

(Continued)

FOREIGN PATENT DOCUMENTS

ES 111517 4/1965
ES 2184539 4/2003

OTHER PUBLICATIONS

Kramer Aluminum Neck guitars, Mar. 7, 2017 [online], http://www.vintagekramer.com/alum.htm.

(Continued)

*Primary Examiner* — Robert W Horn
(74) *Attorney, Agent, or Firm* — Fresh IP PLC; Clifford D. Hyra; Aubrey Y. Chen

(57) ABSTRACT

The invention refers to a stringed musical instrument that is characterised by the inclusion, along the length of the neck of the instrument, of an elongated structure formed by a series of lengths perpendicular to the neck and the structure, which are connected to each other and that divide the fingerboard into independent separable fragments of that structure, and which in the preferred embodiment of the invention, function as frets.

7 Claims, 2 Drawing Sheets

(56) References Cited

U.S. PATENT DOCUMENTS

| | | | | | |
|---|---|---|---|---|---|
| 4,297,936 | A * | 11/1981 | Mouton | G10D 3/06 | 84/314 R |
| 4,334,456 | A * | 6/1982 | Martin | G10D 3/06 | 84/314 R |
| 4,777,858 | A * | 10/1988 | Petschulat | G10D 3/06 | 84/314 R |
| 5,072,643 | A * | 12/1991 | Murata | G10D 3/06 | 84/293 |
| 5,990,396 | A * | 11/1999 | Lasner | G10D 3/06 | 84/267 |
| 6,051,765 | A * | 4/2000 | Regenberg | G10D 3/06 | 84/267 |
| 6,350,940 | B1 * | 2/2002 | Upchurch | G10D 3/06 | 84/290 |
| 7,531,729 | B1 * | 5/2009 | Davis | G10D 3/06 | 84/293 |
| 7,629,521 | B1 * | 12/2009 | Chapman | G10D 3/06 | 84/293 |
| 7,659,464 | B1 * | 2/2010 | Kokodis | G10D 3/06 | 84/293 |
| 9,520,109 | B1 * | 12/2016 | Edwards | G10D 1/08 | |
| 9,524,704 | B2 * | 12/2016 | McSwain | G10D 1/08 | |
| 9,881,593 | B2 * | 1/2018 | Edwards | G10D 1/08 | |
| 2020/0251076 | A1 * | 8/2020 | Jimenez | G10D 3/00 | |

OTHER PUBLICATIONS

Alternative Guitar Design, Background: why and how, Jun. 27, 2007 [online], http://tbeamguitar.blogspot.com.es/2007/06/background-why-and-how.html.

Search Report for International Application PCT/ES2018/070609, dated Apr. 18, 2019.

* cited by examiner

STRINGED MUSICAL INSTRUMENT WITH FRETS THAT ARE JOINED TOGETHER AND DIVIDE THE FINGERBOARD INTO INDEPENDENT DETACHABLE PIECES

Stringed musical instrument with interconnected frets that divide the fingerboard into independent separable fragments.

OBJECT OF THE INVENTION AND TECHNICAL SECTOR CONCERNED

This invention relates to a stringed musical instrument characterised by having, along the length of the neck (4) of the instrument, an elongated structure (FIG. 1), formed by a series of lengths perpendicular (1) to the neck and the structure, which are interconnected and which divide the fingerboard into independent (3) separable fragments of that structure. In the preferred embodiment of the invention, the lengths are connected by a base on which they all rest, functioning as frets for the instrument.

The fact that the frets of the instrument are connected or joined to each other along the length of the neck brings a sound quality to the instrument that clearly improves on those currently existing in the state of the art.

It is considered that the technical sector to which the invention belongs is the field of physics and, in particular, physics applied to the manufacture of stringed musical instruments.

PRIOR ART

Normally, in the field of application of the invention, the frets of a stringed instrument are generally metal bands or strips that are embedded or set in specific grooves marked on the fingerboard, this latter forming a single piece, and they mark the tonal distance, generally by semitones, of the instrument.

A link is provided to an example of a video of the common "refretting" of an electric guitar for ease of understanding: https://www.youtube.com/watch?v=bD93U2_CiW4

Frets are normally manufactured in metal alloys, generally combining nickel, silver and/or steel. The fingerboard, on the other hand, is usually a flat piece of wood (normally ebony, rosewood or maple) that is stuck or glued to the shaft of the instrument. When placing the fingers on the strings and pressing them against the frets embedded in the fingerboard, the sound of the musical notes is produced.

The state of the art existing at the moment of the application shows no stringed musical instrument that incorporates a sectioned or fragmented fingerboard in as many independent sections as frets, but rather the fingerboard (in the stringed instruments that have them, which is not all, as will be shown) is always a single piece on which the grooves or insertions are marked and in which the metal strips forming the frets are embedded.

This common technique of fretting a stringed instrument is the one that is generally used, but it is not the only one. In that sense, there is evidence that the first electric stringed instrument apparently incorporated a neck in a single piece manufactured in aluminium that included the frets themselves in that piece, without those frets being embedded in grooves marked on the fingerboard. That instrument was the subject of a patent invention in the United States No. U.S. Pat. No. 2,089,171. That same technique, or a very similar technique, is apparently used in patent invention No. U.S. Pat. No. 8,324,489. These publications do not obstruct the patentability of the invention for which protection is claimed.

Spanish utility model No. ES0092207 describes the usual fretting technique of a guitar, and apparently claims a fretting system in which the frets are incorporated into the fingerboard forming a single piece with that fingerboard, which its holder calls a "sheet". That publication does not affect the novelty or the inventive step of the invention.

On the other hand, in recent years the use of fingerboards manufactured in materials other than wood, such as aluminium or carbon fibre, has been relatively extended. In that respect, it is worth citing Spanish patent No. ES255348, which claims a neck and fingerboard manufactured in carbon fibre. Also cited, by way of example, are the following publications that disclose the use of necks and/or fingerboards of aluminium:

http://www.ricktoone.com/2016/03/old-growth-walnut-skele.html http://www.electricalguitarcompany.com /http://bastinguitar.com/

There is no indication that any of these instruments use a fretting technique different to the norm because they incorporate frets in grooves marked on the fingerboard, with the peculiarity that, in those specific cases, the fingerboards are not made of wood. They do not therefore, obstruct the patentability of this invention.

The main technical problem for the use of necks made entirely of aluminium (or other metals) or fingerboards and frets both made of metal materials is, precisely, the absence of wood. Certain types of wood generally used in the manufacture of musical instruments (not only stringed instruments) have sound, vibration and sound propagation properties that metal materials do not have, in particular in what is known in the field of the invention as being "warmth" of the sound. This warmth even varies depending on the type of wood used, there being woods that bring greater radiance to the sound of the instrument, others that bring better balance between bass and treble, and others that allow for more defined sounds, for example.

The invention for which protection is claimed shows a technical step on the one hand in the connection of the frets of the instrument (which produces greater sound propagation, a natural increase in volume and greater definition) and, on the other hand, in the preferred embodiment of the invention, in the combination of metal materials (which facilitate that propagation) and wood (which maintains the warmth of sound).

Also identified in the prior art is the use of metal pieces or pieces in other materials embedded in the necks of stringed instruments in combination with wooden fingerboards (we understand that this is to bring rigidity or solidity to the neck of the instrument), but without any variation in the usual fretting using metal strips, and so it does not achieve the particular sound produced by the connection of all the frets as characterised by the invention for which protection is sought. The following publications are cited, by way of example:

http://tbeamguitar.blogspot.com.es/2007/06/background-why-and-how.html http://www.vintagekramer.com/alum.htm These publications do not, therefore, obstruct the patentability of the invention.

Finally, stringed musical instruments have been identified that do not even have a fingerboard, as in the case of patent US2014033905, but this does not obstruct the patentability of the invention for which protection is sought either because this latter incorporates a fingerboard and its fret structure is very different.

There are no indications, therefore, that the invention exists in the prior art, nor are there indications of remotely similar publications, nor is the invention considered to obviously result from the state of the art for an expert in the field as the subject of the invention clearly goes beyond the usual technological steps in the sector.

Explanation of the Invention

The invention consists of a stringed instrument characterised by the inclusion of an elongated structure (FIG. 1), arranged or place on the neck (4) of the instrument that incorporates a collection of lengths (1) perpendicular to this which, in the preferred embodiment of the invention, extend beyond the surface of the fingerboard (3) and function as frets for the instrument, and that are connected to each other through a base on which all of the lengths rest.

Using the mentioned structure, the fingerboard is no longer a single piece that is stuck or glued to the shaft of the instrument, instead it is divided, sectioned or fragmented into as many independent sections (3) as frets the instrument has. This division of the fingerboard into independent sections does not prevent these from being connected, for example, along one of their edges, so that they can be inserted and extracted from the neck (4) as though they were a single unit, instead of having to extract and insert them individually.

The use of this structure (FIG. 1), taking into account that the frets are no longer small metal strips embedded in the fingerboard, but lengths (1) that are higher and more robust, provides the instrument with evident improvements and advantages in terms of sound capacity, as all of the frets of the instrument are connected to each other, which allows the sound produced by the instrument to be dispersed more easily, especially (although not exclusively) if it is electric.

This elongated structure can be of a length that is even longer than the neck itself, reaching the body (6) of the instrument and being incorporated into it, as occurs in the preferred embodiment of the invention, or even forming the body itself. Likewise, it can even reach the head (5) or head stock of the instrument, and even take the shape of the head stock itself at its upper part.

The structure (FIG. 1) can be manufactured in a single piece or in several assemblies.

Finally, the structure (FIG. 1) does not prevent the instrument from incorporating a core or metal bar along the inside length of the neck (4) that allows for its angle to be adjusted to counteract the tension produced by the strings. This is achieved by giving the structure (FIG. 1) a longitudinal bar (2) along its back, forming a "T", into which the core can be placed.

DESCRIPTION OF THE DRAWINGS

This report contains a series of figures with the purpose of facilitating the examiner's and the public's understanding of the described invention for which protection is claimed, which should be taken as mere examples and not limited in nature.

PREFERRED EMBODIMENT OF THE INVENTION

Figure 1:
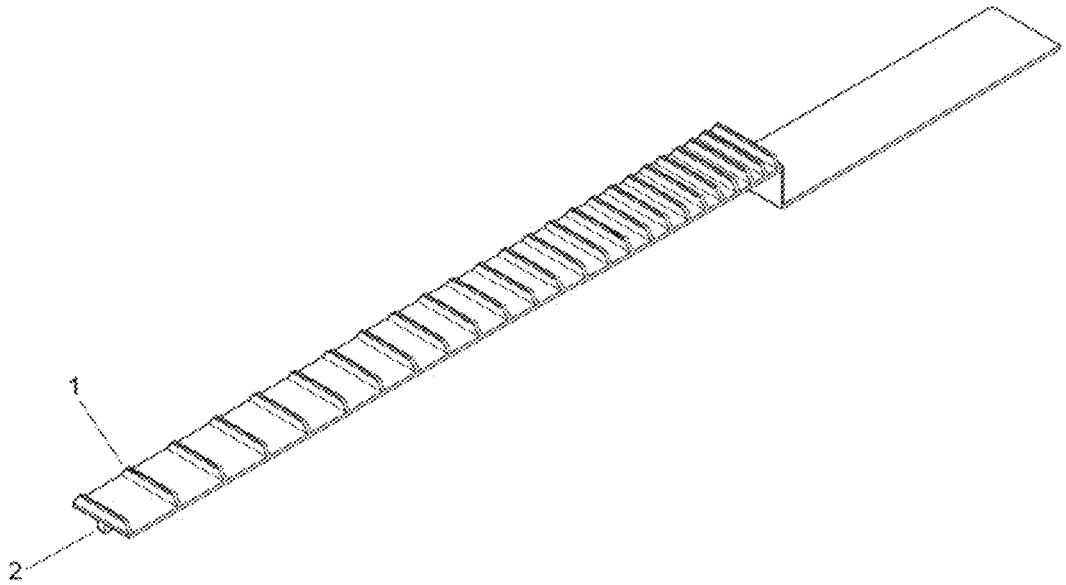
FIG. 1 represents an embodiment of the elongated structure to which we refer in this description, revealing the perpendicular lengths (1) and the longitudinal "T" bar (2), placed along the back of the structure, into which the core of the instrument can be placed.
Figure 2:
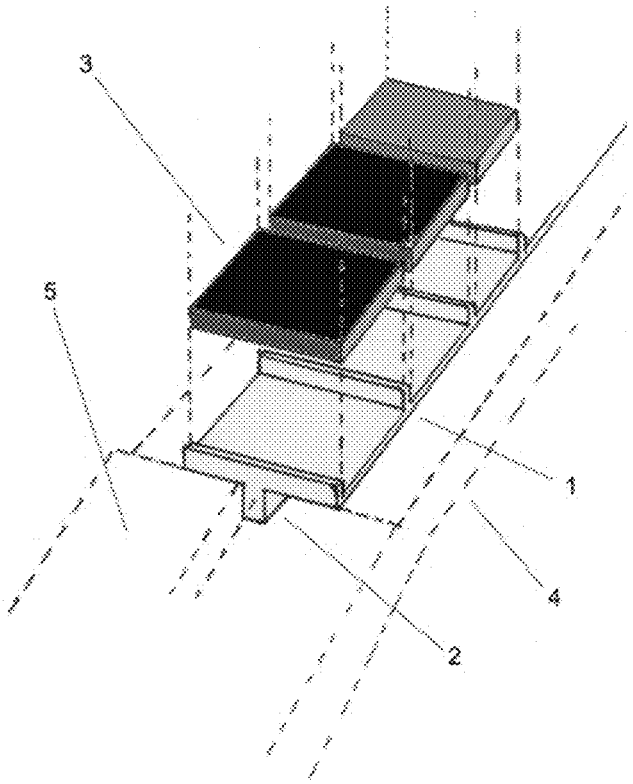
FIG. 2 represents an embodiment of the elongated structure that shows how the independent fragments of the fingerboard would be placed (3), sectioned by the perpendicular lengths (1) and the longitudinal bar placed on the back of the structure (2); as well as the elongated structure itself incorporated in the neck (4) of a stringed instrument.
Figure 3:
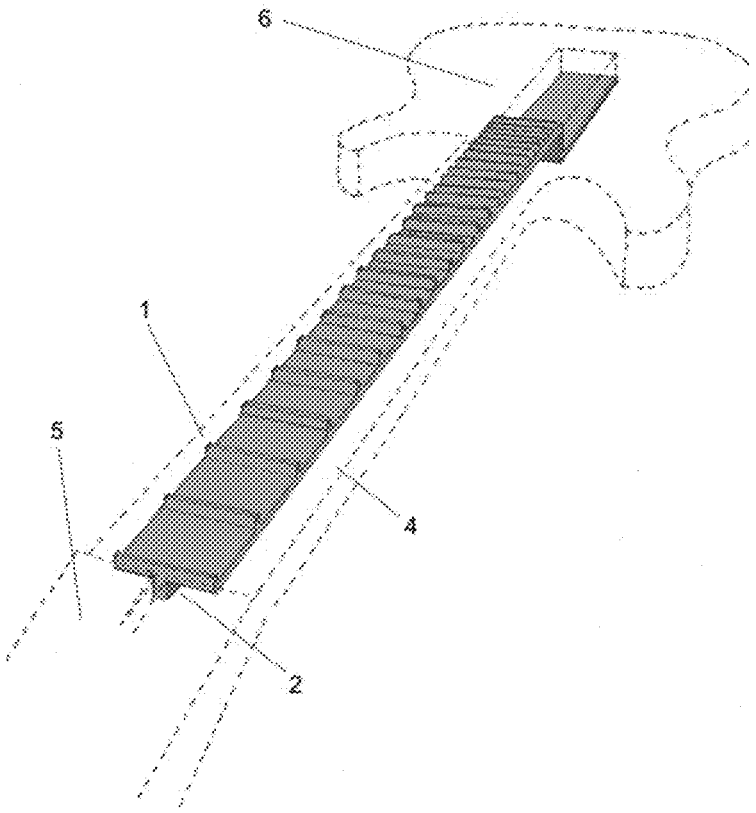
FIG. 3 represents an embodiment of a stringed musical instrument, in this case a guitar, whose neck (4) and part of its body (6) incorporate the elongated structure to which we refer in this description, whose length does not reach the head stock (5) of the instrument.
Figure 4:
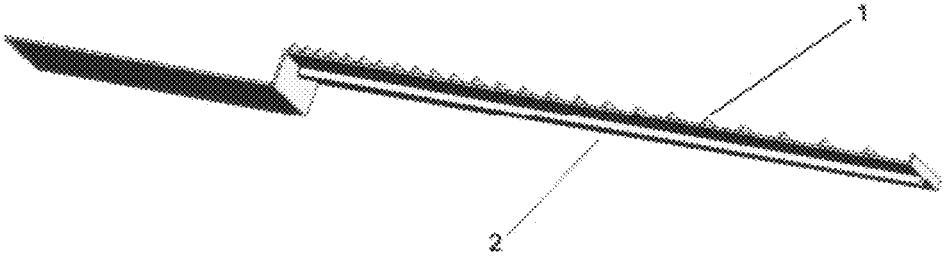
FIG. 4 represents an embodiment of the elongated structure seen from behind, in which the full length of the longitudinal "T" bar (2) can be seen.

An example of preferred embodiment of the invention is an electric guitar (FIG. 3), which includes the elongated structure (FIG. 1) manufactured in Zicral, an aluminium alloy, also known as Ergal or Fortal Constructal, and which forms a single piece.

In the preferred embodiment of the invention the elongated structure (FIG. 1) has been developed in a metal material to facilitate the dispersion of the sound produced by the electric instrument.

In the preferred embodiment of the invention the elongated structure (FIG. 1) contains a series of perpendicular lengths (1) of a sufficient height to meet the surface of the fragments of the fingerboard (3) that is sectioned by the lengths, so that they function as the frets of the instrument.

In the preferred embodiment of the invention one of the ends of the elongated structure (FIG. 1) reaches the body (6) of the instrument and is incorporated into it, but the opposite end does not reach the head stock (5) of the instrument.

In the preferred embodiment of the invention, the independent fragments of the fingerboard (3) are of wood, and the elongated structure (FIG. 1) includes a longitudinal "T" bar (2) on its back, into which the core can be placed, even though in the preferred embodiment it has not been included.

INDUSTRIAL APPLICATION

It is considered that the invention for which protection is claimed has clear industrial application as it is perfectly manufacturable or useable in the music industry in order to provide better sound capacity of stringed instruments.

It is considered that this description is sufficiently clear and precise in order for an expert in the field to understand the scope of the invention and execute it. The terms used in the drafting of this description must be taken in the broadest sense and never limited, and the invention may be used in practice in different forms to that of the preferred embodiment described by way of example, all of which will be covered by the protection claimed, provided they do not modify or alter the basic principle.

The invention claimed is:

1. A stringed musical instrument, comprising:

an elongated structure comprising a front surface and a back surface, the front surface comprising a plurality of lengths that function as frets and that rise vertically perpendicular to a first height above the front surface, thereby dividing the front surface into a plurality of sections; and a fingerboard divided into a plurality of independent segments, wherein each of the plurality of independent segments fits into each of the plurality of sections, wherein each of the plurality of independent segments is separable from each of the plurality of sections.

2. The stringed musical instrument of claim 1, wherein each of the plurality of lengths rise vertically perpendicular to a second height above the plurality of independent segments of the fingerboard.

3. The stringed musical instrument of claim 1, wherein the back surface comprises a longitudinal bar having a T-shape.

4. The stringed musical instrument of claim 1, wherein the elongated structure is manufactured in a single piece.

5. The stringed musical instrument of claim 1, wherein the elongated structure is manufactured of a metal material or a metal alloy.

6. The stringed musical instrument of claim 1, wherein the stringed musical instrument is an acoustic plucked string instrument.

7. The stringed musical instrument of claim 1, wherein the stringed musical instrument is an electric plucked string instrument.

* * * * *